US010436535B1

(12) United States Patent
Bradshaw et al.

(10) Patent No.: US 10,436,535 B1
(45) Date of Patent: Oct. 8, 2019

(54) AUTO SEAR SUCH AS FOR USE WITH ANY AR10 M16 OR OTHER MIDSIZE FIREARM PLATFORM

(71) Applicant: 22 Evolution, Boonville, MO (US)

(72) Inventors: Tyson Bradshaw, Boonville, MO (US); Craig Pudil, Boonville, MO (US); Sean Beahan, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 0 days.

(21) Appl. No.: 16/214,385

(22) Filed: Dec. 10, 2018

Related U.S. Application Data

(60) Provisional application No. 62/623,623, filed on Jan. 30, 2018.

(51) Int. Cl.
*F41A 19/46* (2006.01)

(52) U.S. Cl.
CPC ..... *F41A 19/46* (2013.01)

(58) Field of Classification Search
CPC ..... F41A 19/46; F41A 19/33; F41A 19/44; F41A 19/45
USPC ..... 89/140–142, 149
See application file for complete search history.

(56) References Cited

U.S. PATENT DOCUMENTS

| | | | | |
|---|---|---|---|---|
| 3,045,555 | A * | 7/1962 | Stoner | F41A 19/46 89/142 |
| 4,693,170 | A | 9/1987 | Atchisson | |
| 5,251,533 | A | 10/1993 | Layton | |
| 5,635,664 | A | 6/1997 | Pons et al. | |
| 6,615,527 | B1 * | 9/2003 | Martin | F41A 19/46 42/20 |
| 7,562,614 | B2 | 7/2009 | Polston | |
| 7,654,187 | B2 | 2/2010 | Hochstrate et al. | |
| 7,975,595 | B2 | 7/2011 | Robinson et al. | |
| 9,759,504 | B2 | 9/2017 | Geissele | |
| 2010/0132541 | A1 | 6/2010 | Hochstrate et al. | |
| 2013/0118343 | A1 | 5/2013 | Hirt | |
| 2014/0075814 | A1 | 3/2014 | Larson et al. | |
| 2014/0338523 | A1 | 11/2014 | Daley, Jr. | |

* cited by examiner

*Primary Examiner* — Reginald S Tillman, Jr.
(74) *Attorney, Agent, or Firm* — Dinsmore & Shohl LLP

(57) ABSTRACT

An auto sear for a firearm having a lower receiver with a trigger, disconnector and hammer, and an upper receiver with a reciprocating bolt carrier group. The sear includes a body pivotally mounted within the lower receiver rearwardly of the trigger, disconnector and hammer. The body includes a forward-most planar shaped portion in which are configured each of lower and upper trip engagement location. Upon the hammer initially striking the firing pin, the bolt carrier subsequently displaces rearwardly following cartridge discharge in order to rotate the hammer downwardly into contact with the lower trip engaging location. Upon a return forward displacement of the bolt carrier, an underside ledge thereof contacts the upper trip engaging location in order to pivot the lower engaging location out of contact with the hammer, permitting the same to rotate back into striking contact with the firing pin.

10 Claims, 6 Drawing Sheets

AUTO SEAR SUCH AS FOR USE WITH ANY AR10 M16 OR OTHER MIDSIZE FIREARM PLATFORM

CROSS REFERENCE TO RELATED APPLICATIONS

The present application claims priority of U.S. 62/623,623 filed Jan. 30, 2018.

FIELD OF THE INVENTION

The present invention teaches an auto SEAR for modifying a fully automatic ready firearm platform including a suitably configured fire control group with three position (SAFE, FIRE, AUTO) fire control selector and full auto fire enabled hammer, in combination with a bolt carrier configured for hammer release from the SEAR trip during forward return motion.

DESCRIPTION OF THE BACKGROUND ART

In a firearm, the sear (traditionally defined as a sharp bar resting in a notch) is the part of the trigger mechanism that holds the hammer, striker or bolt until a correct amount of pressure is applied to the trigger, at which point the hammer, striker or bolt is released to discharge the cartridge from the weapon. As is further known, the sear may be a separate part or can be a surface incorporated into the trigger.

The sear on manual firearms is often connected to a disconnector forming a component of the fire control switch and which, after a single cartridge firing cycle in a semi-auto fire position, engages a configured location of the hammer to prevent the same from re-engaging the firing pin until such time as a succeeding and discrete trigger pull is executed.

A full auto sear supplements or replaces the traditional sear and operates to substitute for the disconnector by temporarily catching the hammer once it has been set by the rearwardly traveling bolt and following the hammer initially contacting the firing pin. The hammer includes a further configured notch location which is caught by a pivotally offset location of a "trip" of the sear (and again rather than the hammer being engaged by the disconnector).

Upon the bolt carrier traveling forward in its return buffer spring actuated direction, a notch on the underside of the carrier contacts an upper most location of the trip at a further pivotally offset location from where it is restraining the hammer, at which the continuing forward movement of the carrier causes the trip to be rotated a sufficient degree to release the hammer to again strike the firing pin, the timing for which permits the forward projecting bolt and extractor to strip a cartridge from the magazine and previously load the same into the chamber with the bolt lugs then pre-seated with the bolt receiver lugs.

An auto fire sear can include both those designed into the original manufacture of the firearm, as well as drop in auto sears which typically seat within the open rear interior of the lower receiver behind the trigger housing and which, in combination with a suitable configured fire control group (3 position firing selector with retractable disconnector and correctly designed hammer with secondary trip engaging notch) and bolt carrier group with suitably located notch for engaging the trip in the return direction, provide for converting a semi-automatic for full on auto fire.

The non-patent commercial publication entitled "Bev Fitchett's Guns Magazine—AR15 to M16 Conversion, Dec. 27, 2017, discusses one known version of a drop-in auto sear which teaches a main drop-in body for seating within the open rear of the upper interior behind the trigger group, the body having a modified and irregular rectangular shape with a "U" shaped forward facing profile. A trip component is pivotally supported, via a crosswise extending pin seating through the trip and the main body, between a pair of forwardly extending ears defining the "U" shaped profile.

A forward end face of the trip includes both a lower angled edge adapted to engage the hammer notch during a return upward stroke and an upper angled edge which, upon being contacted by a forwardly displacing underside notch of the bolt carrier during its return stroke, pivots the lower angled edge out of contact with the hammer. In this manner, a fast reciprocating continuous motion of the hammer corresponding to full auto fire occurs until such time as the user releases the trigger, resulting in the disconnector once again re-engaging the hammer in a final returning motion.

Other examples of auto sear constructions include such as that disclosed in US 2014/0338523, to Daley, Jr., which teaches an automatic sear assembly for providing a large-bore rifle with full-automatic firing and/or burst firing capabilities is disclosed. An automatic sear is operatively configured with a sear lever which is provided with bidirectional articulation for selectively imparting torque on the automatic sear to cause tripping thereof. The assembly can be configured such that rotational deflection of the sear lever away from the automatic sear imparts no rotation thereto, whereas rotational deflection of the sear lever toward the automatic sear imparts rotation thereto. Thus, and in accordance with some embodiments, the disclosed sear assembly can be used in a rifle, for example, to utilize the force of a moving bolt carrier during a given firing cycle to initiate a subsequent firing cycle without need to release and once again operate the trigger of the rifle.

Geissele, U.S. Pat. No. 9,759,504, teaches a sear mechanism for a firearm including a trigger element having one or more contact surfaces on which one or more movable or pivotable components of the sear mechanism selectively contracts or slides. In some embodiments, the trigger element is made by producing an intermediate workpiece of the trigger element by a manufacturing process and electric discharge machining the intermediate workpiece of the trigger element to provide the contact surfaces.

Larson, US 2014/0075814, teaches a gas piston style firearm having a bolt carrier, an adjustable gas piston block located forward on the firearm and an over-the-barrel spring and guide rod arrangement, all of which is housed and contained in a top rail that runs the length of the firearm and that maintains the alignment of these firearm components. The firearm further includes components that provide full auto firing capability. These components include a specially designed auto bracket that cooperates with a modified bolt carrier and a modified upper receiver.

Finally, US 2013/0118343, to Hirt, teaches an actuation system which includes a bolt carrier assembly configured for use within a firearm, the bolt carrier assembly including a firing pin configured for striking a chambered round. A hammer assembly is configured for striking the firing pin of the bolt carrier assembly. An auto sear assembly is configured to actuate the hammer assembly during operation of the firearm. A linkage assembly is configured to couple the bolt carrier assembly and the auto sear assembly and effectuate the auto sear assembly actuating the hammer assembly.

SUMMARY OF THE PRESENT INVENTION

The present invention discloses an auto sear for a firearm having a lower receiver with a trigger, disconnector and hammer, and an upper receiver with a reciprocating bolt carrier group. The sear includes a body pivotally mounted within the lower receiver rearwardly of the trigger, disconnector and hammer. The body includes a forward-most planar shaped portion in which are configured each of lower and upper trip engagement locations.

Upon the hammer initially striking the firing pin, the bolt carrier subsequently displaces rearwardly following cartridge discharge in order to rotate the hammer downwardly into contact with the lower trip engaging location. Upon a return forward displacement of the bolt carrier, an underside ledge thereof contacts the upper trip engaging location in order to pivot the lower engaging location out of contact with the hammer, permitting the same to rotate back into striking contact with the firing pin.

Additional features include the body having a multi-bended and angular configuration and including a pair of aligning inner perimeter profiles configured in spaced apart sides for receiving a pin extending crosswise within the lower receiver interior. A selected side of the body extends to a lower terminating leg which is adapted to contact an interior location of the lower receiver associated with the supporting rotatable stem of the firing selector lever.

Other features include the lower trip engaging location further having a flat sharp edge. The upper engagement edge further includes a central-most portion of an upper profile of the trip and which further includes angled side clearance cut locations, the central location adapted to being contacted by the circumferential cross sectional edge profile the underside notch configured into the bolt carrier.

BRIEF DESCRIPTION OF THE DRAWINGS

Reference will now be made to the attached drawings, when read in combination with the following detailed description, wherein like reference numerals refer to like part throughout the several views, and in which.

DETAILED DESCRIPTION OF THE PREFERRED EMBODIMENTS

Figure 1:
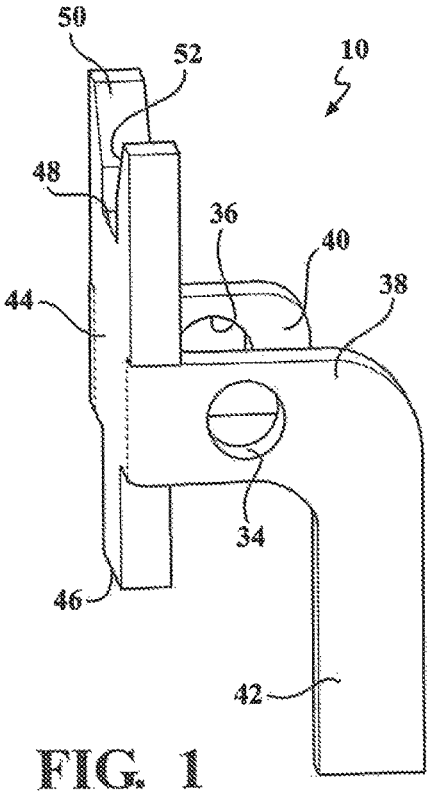
FIG. 1 is a first side looking perspective of a full auto sear according to one embodiment of the present invention.

As previously disclosed, the present invention discloses an auto SEAR for modifying a fully automatic ready firearm platform including a suitably configured fire control group with three position (SAFE, FIRE, AUTO) fire control selector and full auto fire enabled hammer, in combination with a bolt carrier configured for hammer release from the SEAR trip during forward return motion. As further described in reference to the attached illustrations, the auto-sear of the present invention includes a one-piece body which defines the trip and which is pivotally supported within the lower receiver housing to the rear of the trigger assembly. In combination with the reciprocating bolt carrier, the auto sear provides for fast reciprocating motion of the hammer between the firing pin contacting and carrier resetting positions during the time the trigger is depressed, and without interference from the firing switch position adjusted disconnector.

Prior to a description of the auto sear, generally at 10, a basic operating description will be provided of the trigger group associated with a conventional AR/10 platform (however it also being understood that the present SEAR can be adapted to any firearm platform also including but not limited to any AR15/M16 style firearm), it being understood that the auto sear of the present invention is further adaptable to use within any additional firearm platform having a suitably configured hammer (such having a generally "J" or like configuration with a first inner notch for being engaged by the trigger disconnector along with a further outer edge configured ledge for engaging the sear trip) and a reciprocating bolt carrier group with underside configured engagement notch. It is further noted that the operational descriptions are further limited to those components of the fire control (trigger, disconnector, hammer) and bolt carrier group which are relevant to the functionality of the auto sear, with the remaining operational aspects of the firearm platform as known in the relevant art.

A trigger 11 with linkage connected disconnector 12 and a hammer 14 are provided within the lower receiver body (also depicted at 2 in the operational illustrations of FIGS. 4-7 pertaining to the auto sear 10 of the present invention) and which are biased via respective springs (not shown). The disconnector 12 is integrated into the trigger 12 via a selected one of the springs and includes a catch 16 which, depending upon the position of the associated firearm selector (not shown but typically including each of SAFE, FIRE and AUTO positions which serve to move the disconnector in and outer of engaging position with the hammer), engages an interior notch 18 associated with the hammer 14, such further including an outer end engaging tip or ledge 19 additional to the inner curved notch 18 for engaging the sear trip as will be further described.

A trigger guard 20 is integrated into the trigger housing additional hammer 22 and trigger 24 pins are provided for supporting the hammer, trigger and associated pins in the receiver lower frame in order to establish the desired cock, release and reset positions attendant with the discharge and reload steps associated with operation of the AR-15 type firearm.

A further background description of a standardized bolt carrier group associated with the operation of the present invention is also briefly provided and includes a firing pin (not shown) which is secured, via a side installing retaining pin, within a rear of a reciprocating bolt carrier 26. A bolt, referenced by a plurality of forwardly projecting lugs 28, installs, via a plurality (such as three) of gas rings into a front of the bolt carrier 10. Not further shown is each of an extractor pin and ejector roll pin secured to a top of the bolt, with an extractor spring and ejector securing to a forward end of the bolt.

Other features include a cam pin secured to a top of the bolt and projecting upwardly through an arcuate slot configured into the top of the bolt carrier. As previously described, the cam pin contacts an interior guiding location within the upper receiver housing in order to rotate the bolt (in the existing art following linear displacement of forward most located and radially projecting bolt lugs 28 associated with the bolt) in fully seating fashion beyond the associated inward projections of an associated barrel receiver or nut.

The bolt carrier, upon being initially gas discharge displaced in a rearward direction, is counter biased or influenced in a forward return direction through the action of the spring and a buffer assembly (also not shown) supported in the reward and stock direction extending receiver tube.

Other features associated with the bolt carrier 26 include an underside notch 30 which, as will be further described, contacts an upper angled edge of the auto sear/trip for pivoting the trip to release the hammer from contacting the lower angled edge. A bolt carrier key 32 is secured to an upper forward edge of the bolt carrier and, as is known, seats with a rear end of the gas tube incorporated into the upper receiver in order to initiate rearward displacement of the carrier tube by communicating pressurized gas discharge resulting from firing of a cartridge.

Figure 2:
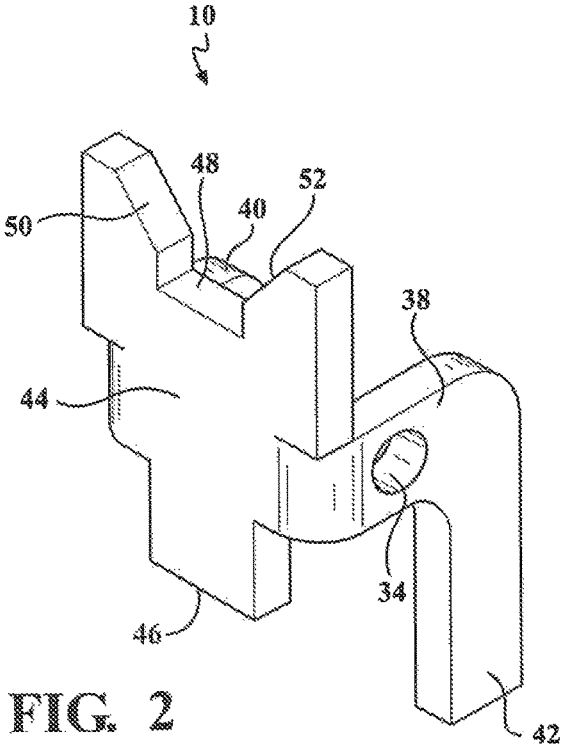
FIG. 2 is a rotated perspective of the sear according to FIG. 1 and illustrating the angled body with intermediate pin mount location in combination with lower and upper trip engagement locations for respectively contacting the hammer notch and the returning bolt carrier.

Following the above overall explanation, and proceeding to FIG. 1, a first side looking perspective of a full auto sear 10 is again shown according to one embodiment of the present invention, with FIG. 2 further providing a rotated perspective of the sear according to FIG. 1. The sear includes a configured and one piece body (as opposed to a two piece body as known in the prior art with a fixed base and separately pivotally attached trip).

Figure 3A:
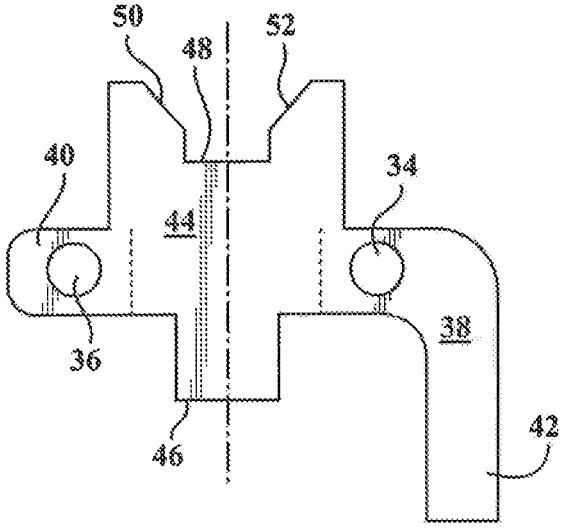
FIG. 3A illustrates a pre-folded metal stamped blank and FIG. 3B illustrates a side folded view of the drop-in auto sear.
Figure 3B:
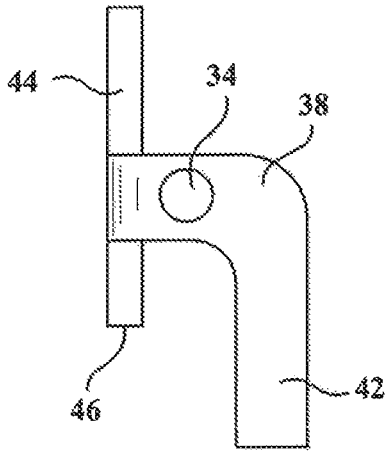

The body is typically constructed of a machined steel or other durable metal, such as which can be initially provided in blank form in FIG. 3A prior to being bent/reconfigured into its desired three dimensional shape. As explained, the sear body 10 is further illustrated with a multi-bended and angular configuration and includes an intermediate pin mount location (see aligning inner perimeter profiles 34 and 36 configured in spaced apart sides 38 and 40 defining parts of the sear body).

A pin 35 (see again FIGS. 4-7) extends crosswise within the lower receiver interior, again shown at 2, above and to the rear of the disconnector 12. A selected side 38 extends to a lower terminating leg 42 which, in the installation views to be further described in FIGS. 4-7, is adapted to contact an interior location of the lower receiver (such as associated with the supporting rotatable stem of the firing control switch for operating the disconnector) and to limit pivotal motion of the sear 10 relative to the engaging outer ledge 19 of the hammer.

Figure 3C:
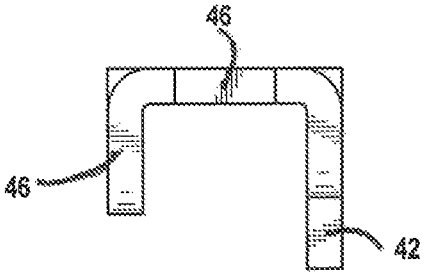
FIGS. 3C and 3D illustrate a further pair of bottom and top plan views of the drop in auto sear.
Figure 3D:
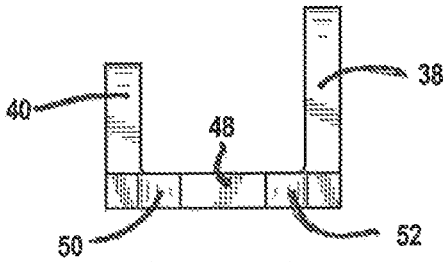

The sides 38/40 of the sear 10 terminate in a forward-most planar shaped portion 44 which in turn configures each of lower 46 and upper 48 trip engagement locations for respectively and alternatingly contacting the hammer outer arcuate ledge 19 and the underside notch 30 in the forward direction returning bolt carrier. As further depicted, the lower engagement location (or edge) is configured by a flat sharp edge 46 which (in the illustrations of FIGS. 5-6) engages the outermost ledge 19 of the upwardly returning hammer 14 following its initial downward rotation as guided by the rearwardly displacing bolt carrier 26. The upper engagement edge, again at 48, defines a central-most portion of an upper profile of the trip and which further includes angled side cut locations 50 and 52, these further adapted to prevent contact with the cut configured on the underside of the bolt carrier 26 for reciprocating operation with the magazine and progressively stripped cartridges. Reference is also made to the bottom and top plan views of FIGS. 3C and 3D.

Figure 4:
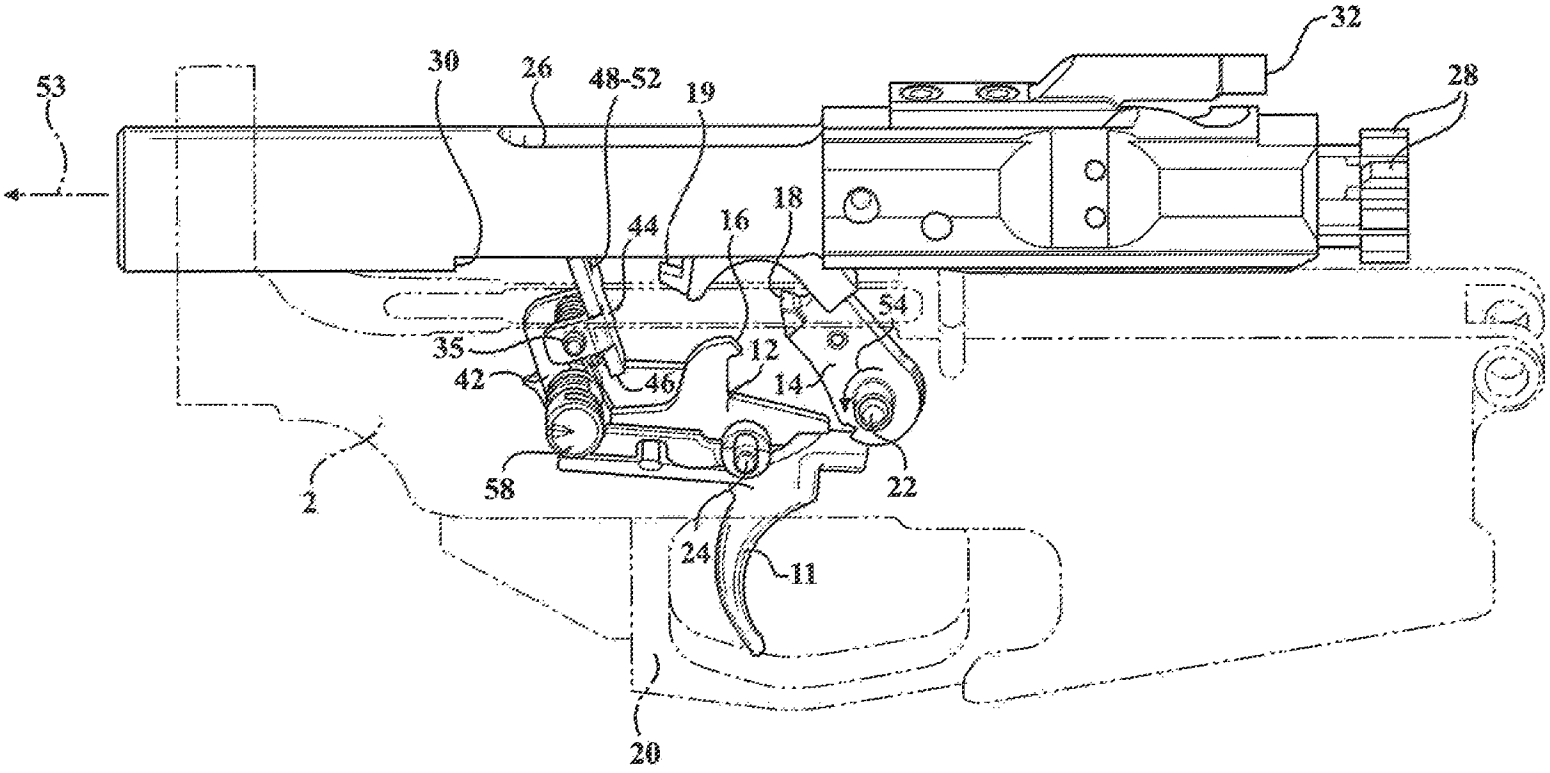
FIG. 4 is an environmental illustration of a rearwardly traveling bolt carrier group, following a firing pin actuated discharge, and in which the carrier is rotating the hammer downwardly into contact with a first engaging location of the rotatable sear trip.
Figure 5:
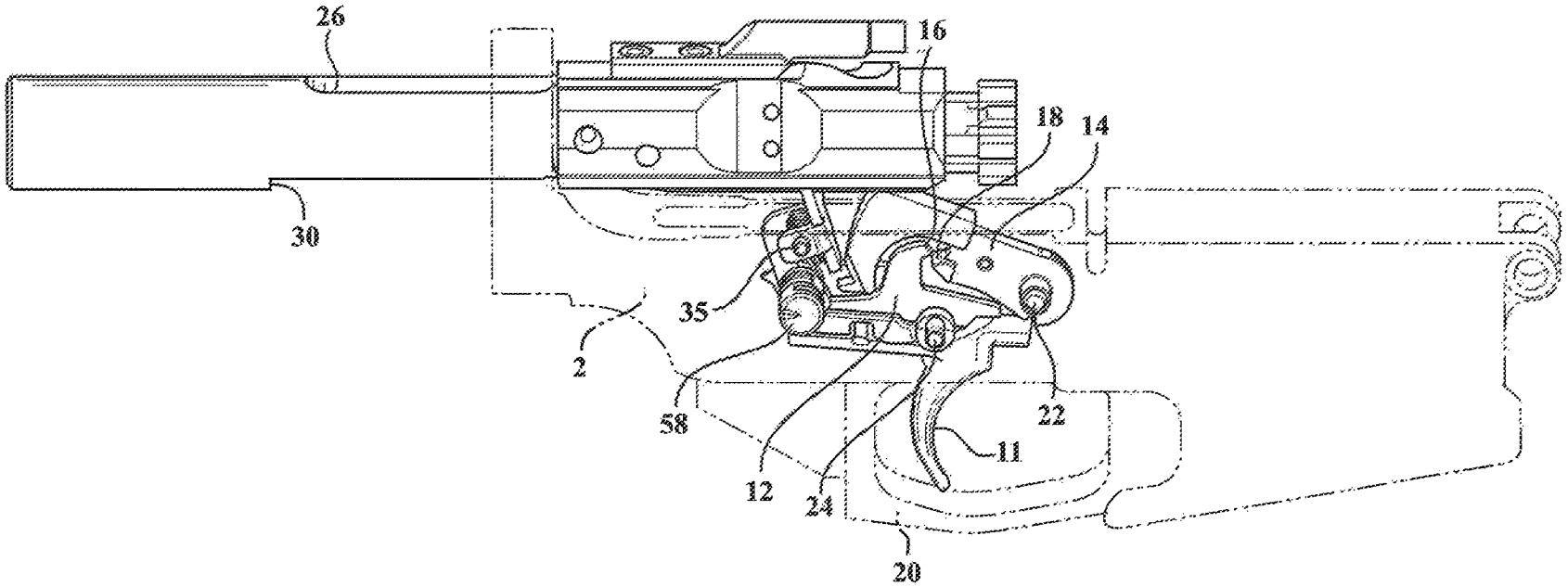
FIG. 5 is a succeeding illustration to FIG. 4 with the carrier depicted in its rearward most travel position and the hammer engaged by the sear trip.

Proceeding to FIG. 4, a first environmental illustration is shown (with the lower receiver 2 interior in substantial see through fashion) of the rearwardly traveling (arrow 53) bolt carrier group 26, this following a firing pin actuated discharge, and in which the carrier is rotating (setting) the hammer 14 downwardly (see directional arrow 54) into a direction in which it will eventually contact with a first engaging location (again at 46) of the rotatable sear trip. FIG. 5 is a succeeding illustration to FIG. 4 with the carrier depicted in its rearward most travel position and the hammer 14 engaged by the sear trip. The hammer 14 in FIG. 5 is depicted in a farthest downwardly pivoted position, the same incrementally rotating upward as shown in FIG. 6 in which the hammer ledge 19 contacts the bottom edge of the trip location at 46.

Figure 6:
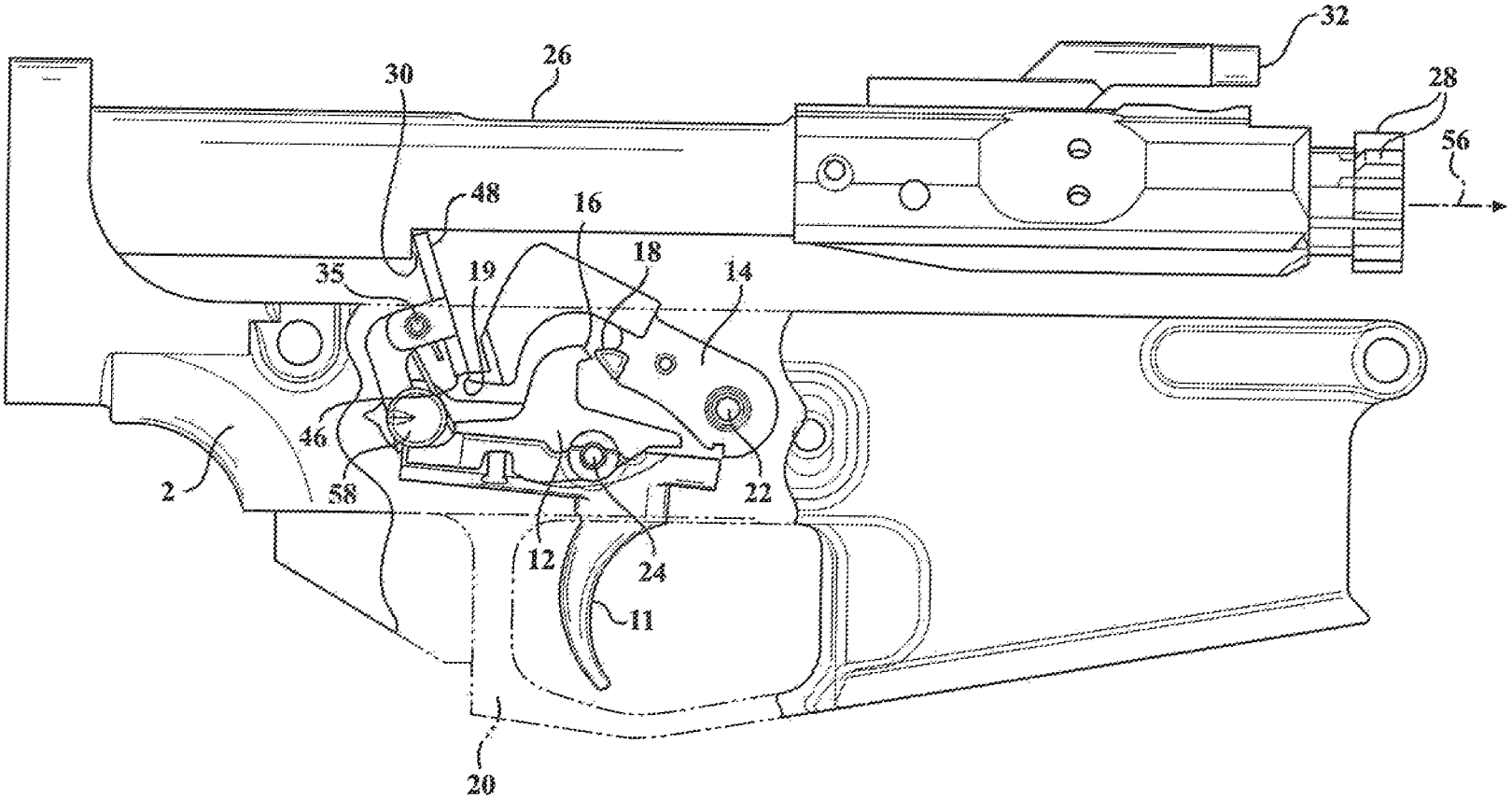
FIG. 6 is a further succeeding illustration with the notch in the forwardly/return displacing bolt carrier contacting an uppermost location of the sear in order to deflect the lower and pivotally offset trip engaging edge (or lower ledge) of the trip out of contact with the hammer (thereby permitting the hammer to again rotated upwardly to strike the firing pin)

FIG. 6 is a further succeeding illustration with the notch in the forwardly/return displacing bolt carrier 26 (arrow 56) contacting an uppermost location (angled interconnected engagement profile surface 48 associated with upper plate shaped end of the ear trip 44) of the sear, this again in order to deflect the lower and pivotally offset trip engaging edge 46 (or lower ledge) of the trip out of contact with the hammer 14 (thereby permitting the hammer to again rotated upwardly to strike the firing pin).

Figure 7:
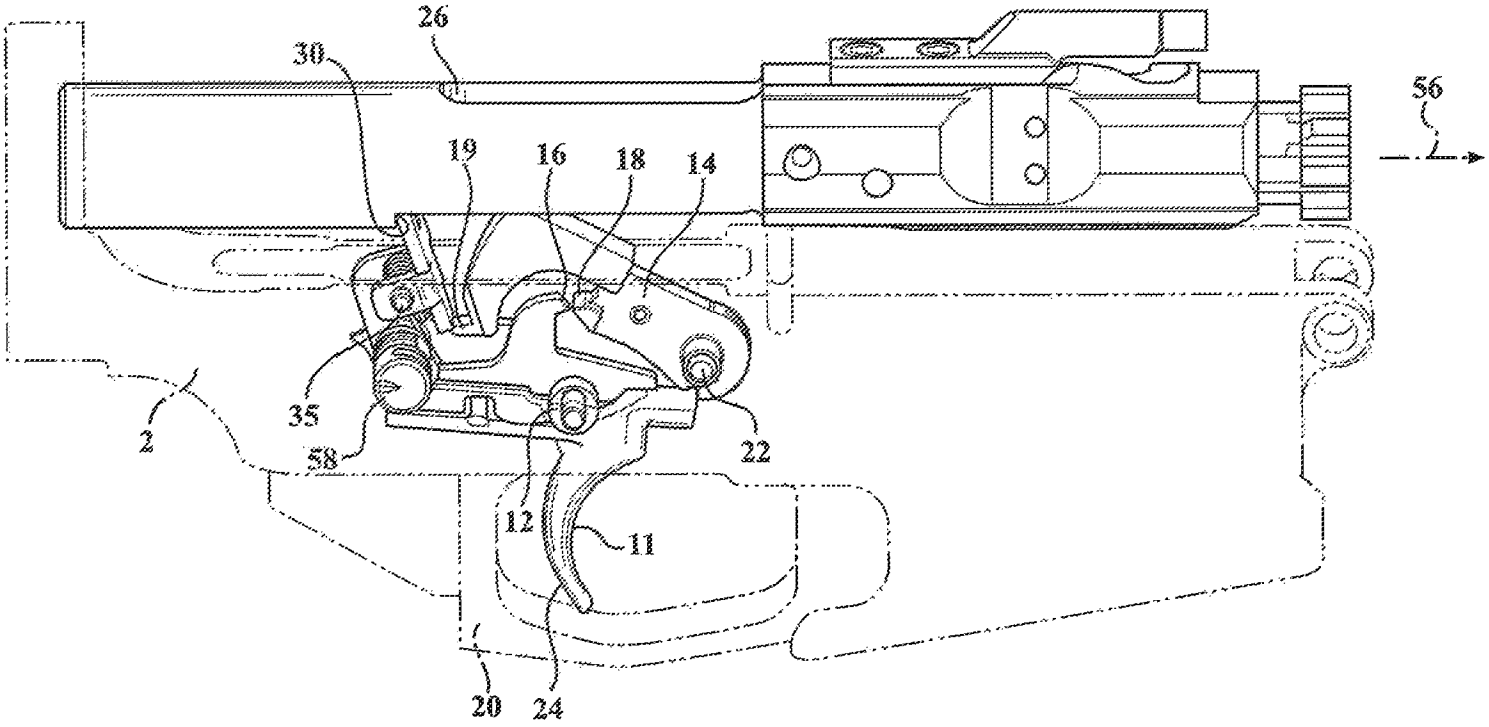
FIG. 7 is a perspective rotated view of the condition described in FIG. 6 concurrent with release of the trip from the hammer.

Finally, FIG. 7 is a perspective rotated view of the condition described in FIG. 6 concurrent with release of the trip from the hammer 14. At this point, the hammer is freed to operate under it pivotally supported spring bias in order to rotate upwardly within the bolt carrier underside recess (hidden) in order to again strike the firing pin (also hidden) concurrent with a succeeding cartridge discharge cycle.

In this fashion, the auto sear, such as which may be spring biased about pin 35 in a limited rotational range as directed by the lower leg 42 contacting the fire select stem, further at 58, provides for reciprocating the hammer 14 between the firing pin and the sear engagement edge 46 (again FIG. 6), and without contacting the disconnector 12 (at ledge 16) when the safety switch selector is positioned in AUTO which causes retraction of the disconnector ledge 16 from seating with the inside notch 18 of the hammer 14 during its reciprocating motion.

Having described my, other and additional preferred embodiments will become apparent to those skilled in invention the art to which it pertains, and without deviating from the scope of the appended claims.

We claim:

1. An auto sear for a firearm having a lower receiver with a trigger, disconnector and hammer, and an upper receiver with a reciprocating bolt carrier group, said sear comprising:

a body adapted to being pivotally mounted within the lower receiver rearwardly of the trigger, disconnector and hammer;

said body including a forward-most planar shaped portion in which are configured each of lower and upper trip engagement locations;

the upper trip engagement location further including a central-most portion of an upper profile of the upper trip and which further includes angled side clearance cut locations which define a central recess configuration which is adapted to being contacted by an underside ledge configured into a cross sectional profile of the bolt carrier;

wherein, upon the hammer initially striking the firing pin, the bolt carrier subsequently displacing rearwardly following cartridge discharge to rotate the hammer downwardly into contact with the lower trip engaging location; and wherein, upon a return forward displacement of the bolt carrier, the underside ledge being adapted to contacting the upper trip engagement location in order to pivot the lower engagement location out of contact with the hammer, permitting the same to rotate back into striking contact with the firing pin.

2. The auto sear of claim 1, further comprising said body having a multi-bended and angular configuration and including a pair of aligning inner perimeter profiles configured in spaced apart sides for receiving a pin extending crosswise within the lower receiver interior.

3. The auto sear of claim 2, further comprising a selected side of said body extending to a lower terminating leg which is adapted to contact an interior location of the lower receiver associated with the supporting rotatable stem of the firing selector lever.

4. The auto sear of claim 1, the lower trip engagement location further comprising a flat sharp edge.

5. An auto sear for a firearm having a lower receiver with a trigger, disconnector and hammer, and an upper receiver with a reciprocating bolt carrier group, said sear comprising:

a body adapted to being pivotally mounted within said lower receiver rearwardly of the trigger, disconnector and hammer, said body having a multi-bended and angular configuration and including a pair of aligning inner perimeter profiles configured in spaced apart sides for receiving a pin extending crosswise within the lower receiver interior;

said body including a forward-most planar shaped portion in which are configured each of lower and upper trip engagement locations;

the upper trip engagement location further including a central-most portion of an upper profile of the upper trip and which further includes angled side clearance cut locations which define a central recess configuration which is adapted to being contacted by an underside ledge configured into a cross sectional profile of the bolt carrier;

wherein, upon the hammer initially striking the firing pin, the bolt carrier subsequently displacing rearwardly following cartridge discharge to rotate the hammer downwardly into contact with the lower trip engagement location; and wherein, upon a return forward displacement of the bolt carrier, an underside ledge thereof adapted to contacting the upper trip engagement location in order to pivot the lower engagement location out of contact with the hammer, permitting the same to rotate back into striking contact with the firing pin.

6. The auto sear of claim 5, further comprising a selected side of said body extending to a lower terminating leg which is adapted to contact an interior location of the lower receiver associated with the supporting rotatable stem of the firing selector lever.

7. The auto sear of claim 5, the lower trip engagement location further comprising a flat sharp edge.

8. An auto sear for a firearm having a lower receiver with a trigger, disconnector and hammer, and an upper receiver with a reciprocating bolt carrier group, said sear comprising:

a body adapted to being pivotally mounted within the lower receiver rearwardly of the trigger, disconnector and hammer;

said body including a forward-most planar shaped portion in which are configured each of lower and upper trip engagement locations, the lower trip engaging location further including a flat sharp edge;

the upper trip engagement location further including a central-most portion of an upper profile of the upper trip and which further includes angled side clearance cut locations, the central location defining a central recess configuration which is adapted to being contacted by an underside ledge configured into a cross sectional profile of the bolt carrier;

the lower trip engagement location further including an inner and downward rectangular projection terminating in a flat sharp edge;

wherein, upon the hammer initially striking the firing pin, the bolt carrier subsequently displacing rearwardly following cartridge discharge to rotate the hammer downwardly into contact with the lower trip engaging location; and wherein, upon a return forward displacement of the bolt carrier, an underside ledge thereof adapted to contacting the upper trip engaging location in order to pivot the lower engaging location out of contact with the hammer, permitting the same to rotate back into striking contact with the firing pin.

9. The auto sear of claim 8, further comprising said body having a multi-bended and angular configuration and including a pair of aligning inner perimeter profiles configured in spaced apart sides for receiving a pin extending crosswise within the lower receiver interior.

10. The auto sear of claim 9, further comprising a selected side of said body extending to a lower terminating leg which is adapted to contact an interior location of the lower receiver associated with the supporting rotatable stem of the firing selector lever.

* * * * *